US007597770B2

(12) United States Patent
Pfannen-Mueller et al.

(10) Patent No.: US 7,597,770 B2
(45) Date of Patent: Oct. 6, 2009

(54) ALUMINUM-BASED ALLOY AND METHOD OF FABRICATION OF SEMIPRODUCTS THEREOF

(75) Inventors: Thomas Pfannen-Mueller, Ottobrunn (DE); Rainer Rauh, Jetzendorf (DE); Peter-Juergen Winkler, Ottobrunn (DE); Roland Lang, Woerth (DE); Iosif Naumovitch Fridlyander, Moscow (RU); Evgeny Nikolaevitch Kablov, Moscow (RU); Vladimir Solomonovitch Sandler, Moscow (RU); Svetlana Nikolaevna Borovskikh, Moscow (RU); Valentin Georgievitch Davydov, Moscow (RU); Valery Vladimirovitch Zakharov, Moscow (RU); Marina Vladimirovna Samarina, Moscow (RU); Viktor Ignatovitch Elagin, Moscow (RU); Leonid Borisovitch Ber, Moscow (RU)

(73) Assignees: EADS Deutschland GmbH, Munich (DE); All Russian Institute of Aviation Materials VIAM, Moscow (RU)

( * ) Notice: Subject to any disclaimer, the term of this patent is extended or adjusted under 35 U.S.C. 154(b) by 123 days.

(21) Appl. No.: 12/010,326

(22) Filed: Jan. 23, 2008

(65) Prior Publication Data

US 2008/0115865 A1 May 22, 2008

Related U.S. Application Data

(62) Division of application No. 10/343,712, filed as application No. PCT/EP01/08807 on Jul. 30, 2001, now abandoned.

(30) Foreign Application Priority Data

Aug. 1, 2000 (RU) ..... 2000120272

(51) Int. Cl.
*C22F 1/057* (2006.01)

(52) U.S. Cl. ..... 148/693; 148/694; 148/698; 148/699

(58) Field of Classification Search ..... 148/693, 148/694, 698, 699
See application file for complete search history.

(56) References Cited

U.S. PATENT DOCUMENTS

| | | | |
|---|---|---|---|
| 4,806,174 | A | 2/1989 | Cho et al. |
| 5,066,342 | A | 11/1991 | Rioja et al. |
| 5,076,859 | A | 12/1991 | Rioja et al. |
| 5,211,910 | A | 5/1993 | Pickens et al. |
| 5,882,449 | A | 3/1999 | Waldron et al. |

FOREIGN PATENT DOCUMENTS

| | | | |
|---|---|---|---|
| RU | 1 785 286 | A1 | 8/1994 |
| WO | WO 96/18752 | A1 | 6/1996 |

OTHER PUBLICATIONS

Database WPI, Section Ch, Week 199518, Derwent Publications Ltd., London, GB; AN 1995-137553; XP002194959.
"Aluminum and Aluminum Alloys", ASM Specialty Handbook, ASM International, 1993, pp. 41, 45.

*Primary Examiner*—Roy King
*Assistant Examiner*—Janelle Morillo
(74) *Attorney, Agent, or Firm*—Crowell & Moring LLP

(57) ABSTRACT

This invention relates to the field of metallurgy, in particular to high strength weldable alloys with low density, of aluminium-copper-lithium system. These alloys can be used in air- and spacecraft engineering. The alloy comprises copper, lithium, zirconium, scandium, silicon, iron, beryllium, and at least one element from the group including magnesium, zinc, manganese, germanium, cerium, yttrium, titanium. A method for fabricating semiproducts is also provided.

7 Claims, No Drawings

ALUMINUM-BASED ALLOY AND METHOD OF FABRICATION OF SEMIPRODUCTS THEREOF

This is a divisional application of application Ser. No. 10/343,712 filed on Feb. 3, 2003, which is a 371 of International Patent Application No. PCT/EP01/08807 filed on Jul. 30, 2001, which claims the benefit of priority based on Russian Patent Application No. 2000-120272 filed on Aug. 1, 2000.

This invention relates to the field of metallurgy, in particular to high strength weldable alloys with low density, of aluminum-copper-lithium system, said invention can be used in air- and spacecraft engineering.

Well-known is the aluminum-based alloy comprising (mass %):

| (OST 1-90048-77) | |
|---|---|
| copper | 2.6-3.3 |
| lithium | 1.8-2.3 |
| zirconium | 0.09-0.14 |
| magnesium | ≦0.1 |
| manganese | ≦0.1 |
| chromium | ≦0.05 |
| nickel | ≦0.003 |
| cerium | ≦0.005 |
| titanium | ≦0.02-0.06 |
| silicon | ≦0.1 |
| iron | ≦0.15 |
| beryllium | 0.008-0.1 |
| aluminum | balance |

The Disadvantage of this Alloy is its Low Weldability, Reduced Resistance to impact loading and low stability of mechanical properties in case of prolonged low-temperature heating.

The aluminum-based alloy with the following composition has been chosen as a prototype: (mass %)

| (RU patent 1584414, C22C 21/12, 1988) | |
|---|---|
| copper | 1.4-6.0 |
| lithium | 1.0-4.0 |
| zirconium | 0.02-0.3 |
| titanium | 0.01-0.15 |
| boron | 0.0002-0.07 |
| cerium | 0.005-0.15 |
| iron | 0.03-0.25 |
| at least one element from the group including: | |
| neodymium | 0.0002-0.1 |
| scandium | 0.01-0.35 |
| vanadiurn | 0.01-0.15 |
| manganese | 0.05-0.6 |
| magnesium | 0.6-2.0 |
| aluminum | Balance |

The disadvantage of this alloy is its reduced thermal stability, not high enough crack resistance, high anisotropy of properties, especially of elongation.

Well-known is the method of fabrication of semiproducts from alloys of Al—Cu—Li system, which method comprises heating of the billet at 470-537° C., hot rolling (temperature of the metal at the end of the rolling process is not specified), hardening from 549° C., stretching (6=2-8%) and artificial aging at 149° C. for 8-24 hours or at 162° C. for 36-72 hours, or at 190° C. for 18-36 hours. (U.S. Pat. No. 4,806,174, C22F 1/04, 1989.)

The shortcoming of this method is the low thermal stability of semiproducts' properties because of the residual supersaturation of the solid solution and its subsequent decomposition with precipitation of fine particles of hardening phases, and also the low elongation and crack resistance, all of which increases the danger of fracture in the course of service life.

The well-known method of fabrication of products from the alloy of Al—Cu—Li system is chosen as a prototype, which method comprising: heating the as-cast billet prior to deformation at 430=480° C., deformation at rolling finish temperature of not less than 375° C., hardening from $525^{\pm 5}$ C, stretching ($\epsilon$=1.5-3.0%) and artificial aging $150^{\pm 5}$ C for 20-30 hours.

(Technological Recommendation for fabrication of plates from 1440 and 1450 alloys, TR 456-2/31-88, VILS, Moscow, 1988.)

The disadvantage of this method is the wide range of mechanical properties' values due to wide interval of deformation temperatures and low thermal stability because of the residual supersaturation of solid solution after aging.

The suggested aluminum-based alloy comprises (mass %):

| | |
|---|---|
| copper | 3.0-3.5 |
| lithium | 1.5-1.8 |
| zirconium | 0.05-0.12 |
| scandium | 0.06-0.12 |
| silicon | 0.02-0.15 |
| iron | 0.02-0.2 |
| beryllium | 0.0001-0.02 |
| at least one element from the group including | |
| magnesium | 0.1-0.6 |
| zinc | 0.01-1.0 |
| manganese | 0.05-0.5 |
| germanium | 0.02-0.2 |
| cerium | 0.05-0.2 |
| yttrium | 0.005-0.02 |
| titanium | 0.005-0.05 |
| aluminum | balance |

The Cu/Li ratio is in the range 1.9-2.3.

Also is suggested the method for fabrication of semiproducts, comprising heating of as-cast billet to 460-500° C., deformation at temperature≧400° C., water quenching from 525° C., stretching ($\epsilon$=1.5-3.0%), three-stage artificial aging including:

| | |
|---|---|
| I | 155-165° C. for 10-12 hours, |
| II | 180-190° C. for 2-5 hours, |
| III | 155-165° C. for 8-10 hours, |

with subsequent cooling in a furnace to 90-100° C. with cooling rate 2-5° C. hours and air cooling to room temperature.

The suggested method differs from the prototype in that the billet prior to deformation process, is heated to 460-500° C., the deformation temperature is not less than 400° C., and the artificial aging process is performed in three stages: first at 155-165° C. for 10-12 hours, then at 180-190° C. for 2-5 hours and lastly at 155-165° C. for 8-10 hours; then is performed cooling to 90-100° C. with cooling rate of 2-5° C./hour and subsequent air cooling to room temperature.

The task of the present invention is the weight reduction of aircraft structures, the increase in their reliability and service life.

The technical result of the invention is the increase in plasticity, crack resistance, including the impact loading resistance, and also the increase in stability of mechanical properties in case of prolonged low-temperature heating.

The suggested composition of the alloy and the method of fabrication of semi-products from said alloy ensure the necessary and sufficient saturation of the solid solution, allowing to achieve the high hardening effect at the expense of mainly fine T,-phase ($Al_2CuLi$) precipitates without residual supersaturation of the solid solution with Li, and that results in practically complete thermal stability of the alloy in case of prolonged low-temperature heating.

Besides that, the volume fraction and the morphology of hardening precipitate particles on grain boundaries and inside grains are those, that they allow to achieve high strength and flowability as well as high plasticity, crack resistance and impact loading resistance.

Due to $Al_3$(Zr, Sc) phase particles' precipitation, the suggested alloy composition provides the formation of uniform fine-grained structure in the ingot and in a welded seam, absence of recrystallization (including the adjacent-seam zone) and hence, good resistance to weld cracks.

Thus, the suggested alloy composition and method for fabrication semi-products thereof, allow to achieve a complex of high mechanical properties and damage tolerance characteristics including-good impact behavior due to favorable morphology of hardening precipitates of T,-phase upon minimum residual supersaturation of solid solution, which results in high thermal stability. The alloy has low density and high modulus of elasticity. The combination of such properties ensures the weight saving (15%) and 25% increase in reliability and service life of the articles.

The example below is given to show the embodiment of the invention.

EXAMPLE

The flat ingots (90×220 mm cross selection) were cast from 4 alloys by semi-continuous method. The compositions of said alloy are given in Table 1.

The homogenized ingots were heated in an electric furnace prior to rolling. Then the sheets of 7 mm thickness were rolled. The rolling schedule is shown in Table 2. The sheets were water quenched from 525° C., then stretched with 2,5-3 I permanent set. The aging was performed as follows:

| | |
|---|---|
| 1 stage | 160° C., 10-12 hours |
| 2 stage | 180° C., 3-4 hours |
| 3 stage | 160° C., 8-10 hours. |

The sheets made of the alloy-prototype were aged according to the suggested schedule and according to the method-prototype (150° C., 24 hours).

Some of the sheets (after aging) were additionally heated at 115° C., 254 hours, what equals to heating at 90° C. for 4000 hours when judging by the degree of structural changes and changes in properties.

The results of tests for mechanical properties determination are shown in Tables 3-4. The data given in said Tables evidently show that the suggested alloy and method for fabrication of semiproducts, thereof as compared with the prototypes, are superior in hot rolled sheets' properties, namely in elongation—by 10%, in fracture toughness—by 15%, in specific impact energy—by 10% while their ultimate strength and flowability are nearly the same.

The highest superiority was observed in thermal stability of properties after prolonged low-temperature heatings.

Thus, the properties of the sheets fabricated from the invented alloy by the invented method practically do not change. After heating nearly all the properties do not change by more than 2-5%.

On the contrary, the alloy-prototype showed: the ultimate strength and flowability increased by 6%, elongation reduced by 30%, fracture toughness reduced by 7%, the rate of fatigue crack growth increased by 10%, impact resistance reduced by 5%.

The comparison of the properties evidently show, that the suggested alloy and method for fabrication of semiproducts thereof can provide structure weight reduction (owing to high strength and crack resistance) by not less than 15% and increase in reliability and service life of articles by not less than 20%.

TABLE 1

| | | Composition of the alloys, mass % | | | | | | | | | | | | | | |
|---|---|---|---|---|---|---|---|---|---|---|---|---|---|---|---|---|
| Alloy | Composition | Cu | Li | Zr | Sc | Si | Fe | Be | Mg | Mn | Zn | Ce | Ti | Y | Al | Cu/Li |
| Invented | 1 | 3.4 | 1.5 | 0.08 | 0.09 | 0.04 | 0.02 | 0.07 | 0.3 | 0.15 | — | — | — | 0.001 | Bal. | 2.26 |
| | 2 | 3.48 | 1.76 | 0.11 | 0.069 | 0.05 | 0.02 | 0.06 | 0.28 | 0.31 | 0.2 | — | 0.001 | 0.001 | Bal. | 1.98 |
| | 3 | 3.1 | 1.63 | 0.07 | 0.1 | 0.1 | 0.2 | 0.0001 | 0.56 | 0.3 | — | 0.1 | 0.001 | — | Bal. | 1.90 |
| Prior Art (Prototype) | 4 | 3.0 | 1.75 | 0.11 | 0.09 | 0.08 | — | — | 0.56 | 0.27 | — | — | | — | Bal. | 1.71 |

TABLE 2

| | | Technological schedule of fabrication of the sheets | | | | | |
|---|---|---|---|---|---|---|---|
| | | Temperature of billet heating prior to | Temperature of metal at rolling | Permanent set at | Aging | | |
| Alloy | Composition | rolling, ° C. | finish, ° C. | stretching, % | 1 stage | 2 stage | 3 stage |
| Invented | 1 | 490 | 420 | 3.0 | 160° C., 10 h | 180° C., 3 h | 160° C., 10 h |
| | 2 | 460 | 410 | 2.5 | 160° C., 12 h | 180° C., 4 h | 160° C., 10 h |
| | 3 | 460 | 410 | 2.5 | 160° C., 10 h | 180° C., 3 h | 160° C., 8 h |

TABLE 2-continued

Technological schedule of fabrication of the sheets

| Alloy | Composition | Temperature of billet heating prior to rolling, ° C. | Temperature of metal at rolling finish, ° C. | Permanent set at stretching, % | Aging 1 stage | Aging 2 stage | Aging 3 stage |
|---|---|---|---|---|---|---|---|
| Prior Art (Prototype) | 4 | 480 | 400 | 2.8 | 160° C., 10 h | 180° C., 3 h | 160° C., 10 h |
| | 4' | 480 | 380 | 2.8 | | 150° C., 24 h | |

Note:
1) sheets of alloy 1-3 prior to stretching, were hardened from 525° C., of alloy 4 - from 530° C.
2) 4' - aging according to prototype method.

TABLE 3

Mechanical properties of hot-rolled sheets in as-aged condition (longitudinal direction)

| Alloy | Composition | UTS, MPa | YTS, MPa | Elongation, % | Critical* coefficient of stress intensity $K_{co}$, MPa√ ΔK = 32 | Fatigue crack growth rate dl/dN, mm/k cycl. ΔK = 32 | Specific impact energy under loading E, J/mm |
|---|---|---|---|---|---|---|---|
| Inventive | 1 | 569 | 534 | 9.5 | 65.8 | 2.35 | 18.2 |
| | 2 | 657 | 542 | 9.1 | 64.3 | 2.4 | 17.6 |
| | 3 | 560 | 530 | 10.8 | 66.4 | 2.2 | 18.4 |
| Prototype | 4 | 570 | 540 | 8.9 | 58.6 | 3.68 | 16.1 |
| | 4' | 550 | 523 | 12.8 | 69.2 | 2.6 | 16.9 |

*width of samples (w) - 160 mm

TABLE 4

Mechanical properties of hot-rolled sheets after prolonged low-temperature heating (115° C., 254 hours)

| Alloy | Composition | UTS, MPa | YTS, MPa | Elongation, % | Critical* coefficient of stress intensity $K_{co}$, MPa√ ΔK = 32 MPa√ | Fatigue crack growth rate dl/dN, mm/k cycl. ΔK = 32 MPa√ | Specific impact energy under loading E, J/mm |
|---|---|---|---|---|---|---|---|
| Inventive | 1 | 570 | 534 | 9.5 | 64.5 | 2.07 | 18.0 |
| | 2 | 578 | 545 | 8.4 | 65.2 | 2.4 | 17.6 |
| | 3 | 565 | 532 | 10.6 | 67.2 | 2.1 | 18.5 |
| Prototype | 4 | 599 | 567 | 6.4 | 58.1 | 3.71 | 15.4 |
| | 4' | 586 | 547 | 8.1 | 64.2 | 2.9 | 16.2 |

The invention claimed is:

1. A method for fabricating a sheet of an aluminum-based alloy comprising 3.0-3.5% copper, 1.5-1.8% lithium, 0.05-0.12% zirconium, 0.06-0.12% scandium, 0.02-0.15% silicon, 0.02-0.2% iron, 0.0001-0.02% beryllium; and at least one element selected from the group consisting of 0.1-0.6% magnesium, 0.02-1.0% zinc, 0.05-0.5% manganese, 0.02-0.2% germanium, 0.05-0.2% cerium, 0.005-0.02% yttrium and 0.005-0.05% titanium; and aluminum which makes up the balance, wherein the ratio between copper/lithium (Cu/Li) is between about 1.9 and about 2.3, comprising heating a billet of the alloy to 460-500° C., deforming at a temperature of ≧400° C., aging at 155-165° C. for 10-12 hours, aging at 180-190° C. for 2-5 hours and aging at 155-165° C. for 8-10 hours;

cooling the billet to 90-100° C. with cooling rate of 2-5° C./hour, and air cooling to room temperature.

2. The method of claim 1, wherein the Cu/Li is 1.90.

3. The method of claim 1, comprising heating a billet of the alloy to 490° C., rolling the billet such that the temperature of the alloy at rolling finish is 420° C., and aging the alloy at 160° C. for 10 hours, aging the alloy at 180° C. for 3 hours, and aging the alloy at 160° C. for 10 hours.

4. The method of claim 1, comprising heating a billet of the alloy to 460° C., rolling the billet such that the temperature of the alloy at rolling finish is 410° C., and aging the alloy at 160° C. for 12 hours, aging the alloy at 180° C. for 4 hours, and aging the alloy at 160° C. for 10 hours.

5. The method of claim 1, comprising heating a billet of the alloy to 460° C., rolling the billet such that the temperature of the alloy at rolling finish is 410° C., and aging the alloy at 160° C. for 10 hours, aging the alloy at 180° C. for 3 hours, and aging the alloy at 160° C. for 8 hours.

6. The method of claim 1, further comprising water quenching from 525° C.

7. The method of claim 1, further comprising stretching (ϵ=1.5-3.0%).

* * * * *